US009784059B2

(12) United States Patent
Gonzalez

(10) Patent No.: US 9,784,059 B2
(45) Date of Patent: Oct. 10, 2017

(54) SELECTIVE ORIENTATION AND LOCATION SYSTEM

(71) Applicant: Schlumberger Technology Corporation, Sugar Land, TX (US)

(72) Inventor: Luis A. Gonzalez, Houston, TX (US)

(73) Assignee: SCHLUMBERGER TECHNOLOGY CORPORATION, Sugar Land, TX (US)

( * ) Notice: Subject to any disclaimer, the term of this patent is extended or adjusted under 35 U.S.C. 154(b) by 247 days.

(21) Appl. No.: 14/434,107

(22) PCT Filed: Oct. 10, 2013

(86) PCT No.: PCT/US2013/064241
§ 371 (c)(1),
(2) Date: Apr. 8, 2015

(87) PCT Pub. No.: WO2014/059081
PCT Pub. Date: Apr. 17, 2014

(65) Prior Publication Data

US 2015/0259999 A1 Sep. 17, 2015

Related U.S. Application Data

(60) Provisional application No. 61/713,249, filed on Oct. 12, 2012.

(51) Int. Cl.
*E21B 23/02* (2006.01)
*E21B 47/09* (2012.01)

(52) U.S. Cl.
CPC ..... *E21B 23/02* (2013.01); *E21B 47/09* (2013.01)

(58) Field of Classification Search
CPC ..... E21B 23/03; E21B 23/02; E21B 47/09
See application file for complete search history.

(56) References Cited

U.S. PATENT DOCUMENTS

| | | | | |
|---|---|---|---|---|
| 5,927,401 | A * | 7/1999 | Morris | E21B 23/002 166/191 |
| 6,012,527 | A | 1/2000 | Nitis et al. | |
| 2005/0006100 | A1 | 1/2005 | Murray et al. | |
| 2007/0144741 | A1 | 6/2007 | Cho et al. | |
| 2007/0295502 | A1 * | 12/2007 | Watson | E21B 43/128 166/254.2 |
| 2008/0156479 | A1 | 7/2008 | Cassidy et al. | |
| 2010/0282475 | A1 * | 11/2010 | Darnell | E21B 34/14 166/373 |
| 2011/0174068 | A1 | 7/2011 | Irani et al. | |

OTHER PUBLICATIONS

International Search Report and Written Opinion dated Jan. 9, 2014, for PCT/US2013/064241, filed on Oct. 10, 2013.

* cited by examiner

*Primary Examiner* — David Bagnell
*Assistant Examiner* — Manuel C Portocarrero
(74) *Attorney, Agent, or Firm* — Jeffery R. Peterson

(57) ABSTRACT

A technique facilitates use of a flexible conveyance, e.g. coil tubing or slick line, for placing a tool in a tubing string. The tool is coupled to an orienting and locating mechanism which is used to deploy the tool through a tubing string via a flexible conveyance. The tool is oriented by reciprocating the orienting and locating mechanism between orienting profiles. Once the tool is oriented, the orienting and locating mechanism is latched at a desired longitudinal location by a releasable key.

19 Claims, 5 Drawing Sheets

SELECTIVE ORIENTATION AND LOCATION SYSTEM

BACKGROUND

In a wide range of oilfield service applications, various tools are located and/or oriented during construction of multilateral junctions. A given tool is run downhole on tubing, rotated by the tubing to a desired orientation, and positioned at a desired location. However, if the surrounding production tubing is relatively small, the tool size is reduced and the smaller tools are run through the narrow diameter production tubing via slick line and/or coil tubing. When using slick line or coil tubing as the working string to run the job, the ability to rotate the tool to a desired orientation is limited and sometimes unavailable.

SUMMARY

In general, a system and methodology are provided for utilizing a flexible conveyance, e.g. coil tubing or slick line, when placing a tool in a tubing string. The tool is coupled to an orienting and locating mechanism which is used to deploy the tool through a tubing string via the flexible conveyance. The tool is oriented by reciprocating the orienting and locating mechanism between orienting profiles. Once the tool is oriented, the orienting and locating mechanism is latched at a desired longitudinal location by a releasable key.

However, many modifications are possible without materially departing from the teachings of this disclosure. Accordingly, such modifications are intended to be included within the scope of this disclosure as defined in the claims.

BRIEF DESCRIPTION OF THE DRAWINGS

Certain embodiments of the disclosure will hereafter be described with reference to the accompanying drawings, wherein like reference numerals denote like elements. It should be understood, however, that the accompanying figures illustrate the various implementations described herein and are not meant to limit the scope of various technologies described herein, and.

DETAILED DESCRIPTION

In the following description, numerous details are set forth to provide an understanding of some embodiments of the present disclosure. However, it will be understood by those of ordinary skill in the art that the system and/or methodology may be practiced without these details and that numerous variations or modifications from the described embodiments may be possible.

The disclosure herein generally involves a system and methodology related to selective orientation and location of a tool within a tubing string. For example, the system and methodology may be used in a variety of well related applications to orient and locate lateral deflectors, isolators, and/or other tools in tubing strings, such as completion strings having relatively small diameters. In multilateral well applications, the technique may be used to deliver and orient a tool at a specific lateral junction within a tubing string module located at the specific multilateral completion junction. By way of example, a tool may be oriented and located to facilitate an intervention operation in a desired main bore or lateral bore extending from the main bore.

The system and methodology utilize an orienting and locating mechanism which has a simple and reliable design. The orienting and locating mechanism may be coupled to a tool and delivered downhole through the tubing string via a conveyance, such as coil tubing or slick line. In intervention applications, the orienting and locating mechanism may be used to land intervention equipment within completion equipment having smaller sizes. The mechanism, in cooperation with the surrounding tubing string module, enables rotational orientation of the tool through longitudinal moments rather than through work string rotation.

In multilateral well applications, the system and methodology enable selection of a desired lateral junction, orientation of the tool, and appropriate location of the tool relative to the lateral bore. The tool may comprise an isolator or a lateral deflector used in cooperation with, for example, a Y-block. The isolator may be positioned to isolate a main bore from the lateral bore to enable an intervention operation or other operation in the main bore. The lateral deflector may be oriented toward the lateral bore to facilitate an intervention operation or other operation in the lateral bore. In this type of application, the isolator or the lateral deflector may be oriented and properly located in a tubing string module assembly corresponding with a multilateral junction of a multilateral completion tubing string. However, a variety of other tools may be used in other types of tubing strings.

Figure 1:
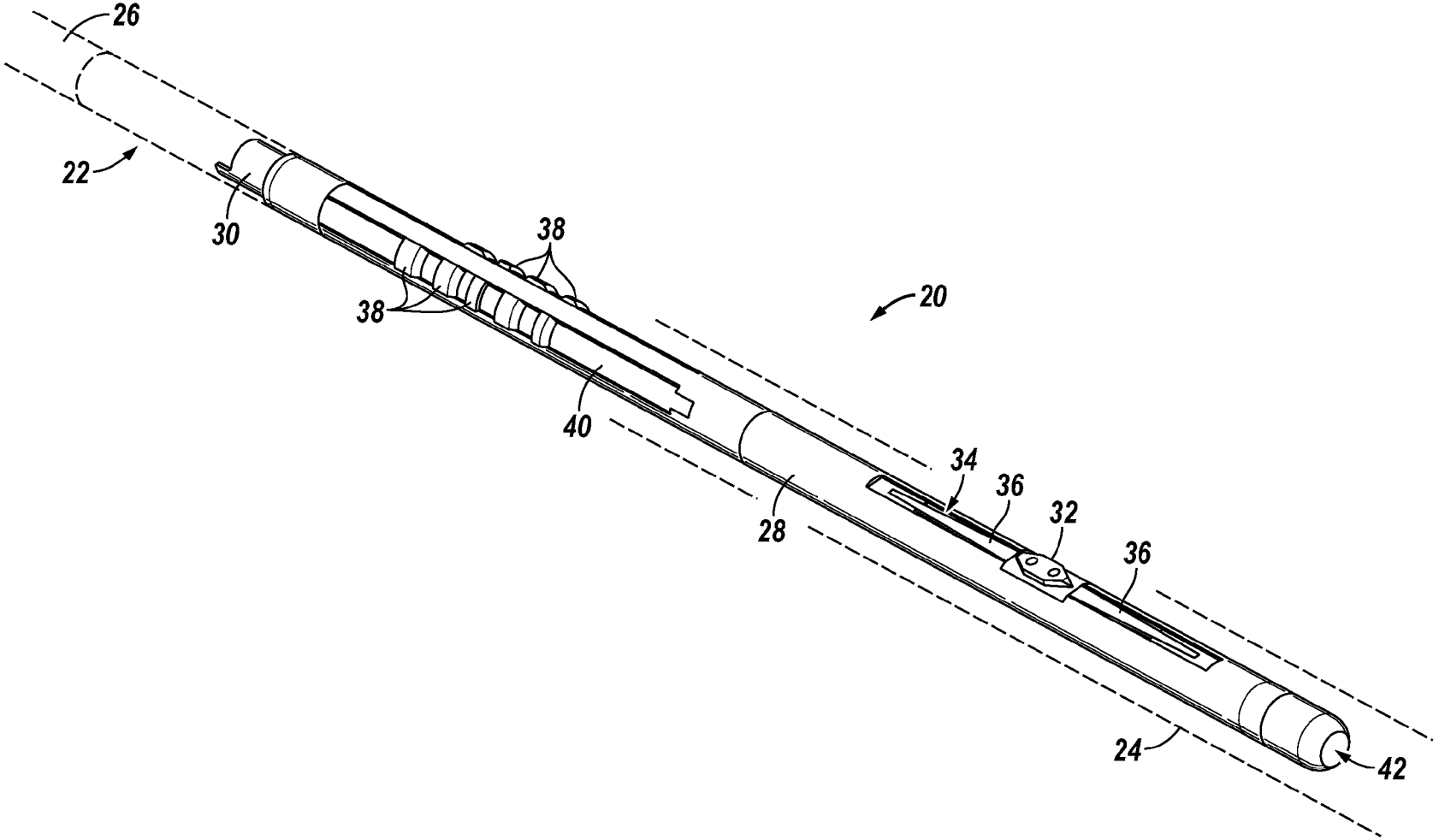
FIG. 1 is an orthogonal view of an example of an orienting and locating mechanism coupled with a tool and a conveyance, according to an embodiment of the disclosure.

Referring generally to FIG. 1, an embodiment of an orienting and locating mechanism 20 is illustrated. In this embodiment, the orienting and locating mechanism 20 is coupled with a tool 22, e.g. a lateral deflector or isolator, and deployed into a tubing string 24, such as a multilateral completion tubing string. The orienting and locating mechanism 20 along with tool 22 may be deployed into the tubing string 24 via a conveyance 26. In this example, conveyance 26 is a flexible conveyance, such as coil tubing or slick line.

In the embodiment illustrated, the orienting and locating mechanism 20 comprises a body 28, e.g. a cylindrical body, having a connector end 30 designed for coupling with tool 22. As explained in greater detail below, an embodiment of connector end 30 may use a castellated geometry designed to allow a desired alignment with tool 22. An orienting key 32 is mounted to extend through an opening 34 of the body 28. The orienting key 32 may be spring mounted in a manner which tends to resist radially inward motion of the orienting key and to spring bias the orienting key 32 in a radially outward direction to extend from opening 34. In some applications, the spring bias may be established by mounting the orienting key 32 on a spring or a pair of springs 36, such as a pair of beam springs.

As illustrated, the orienting and locating mechanism 20 also comprises a locating key 38 which may be in the form of a plurality of locating keys mounted on body 28. By way of example, the locating keys 38 may comprise three different and unique keys that, when assembled on body 28, match a corresponding latching profile in a surrounding tubing completion, thus providing the ability to locate and lock in place mechanism 20 and tool 22. Similar to the orienting key 32, the locating keys 38 may be spring mounted via a spring member 40 to enable radially inward deflection. In some embodiments, each locating key 38 is mounted on a separate spring member 40 and each separate spring member may be in the form of a beam spring allowing individual deflection of each locating key 38. In this example, each beam spring 40 is mounted onto the body 28 at a specific location to achieve the desired pattern of locating keys 38. The ability to deflect orienting key 32 and locating keys 38 in a radially inward direction facilitates movement of the orienting and locating mechanism 20 along the interior of tubing string 24 to the desired location for tool 22. Once at the desired location, the orienting key 32 is moved radially outward via the spring bias to engage an orienting mechanism, as described in greater detail below. Similarly, the locating key or keys 38 may be spring biased to a radially outward positioned for engagement with a corresponding key profile. It should be noted that the orienting and locating mechanism 20 often may be designed with an open internal passage 42 which enables passage of fluid and/or equipment, such as intervention equipment.

Figure 2:
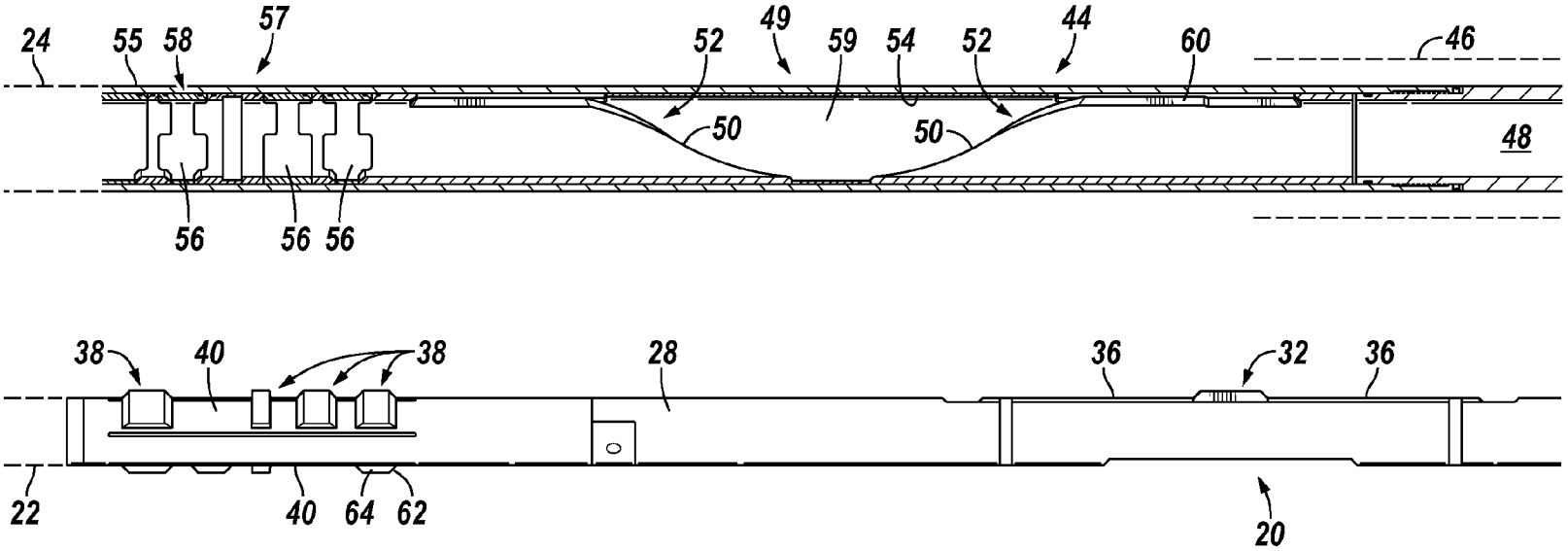
FIG. 2 is an exploded view illustrating an example of the orienting and locating mechanism alongside of a corresponding tubing string module, according to an embodiment of the disclosure.

Referring generally to FIG. 2, an embodiment of the orienting and locating mechanism 20 is illustrated adjacent a tubing string module 44 of tubing string 24. By way of example, tubing string module 44 may comprise a selective lateral intervention completion module positioned proximate a lateral bore of a multilateral well 46. The tubing string module 44 comprises an interior 48 into which orienting and locating mechanism 20 may be deployed. In FIG. 2, however, the orienting and locating mechanism 20 is illustrated as exploded or separated from the interior 48 to better illustrate the features of tubing string module 44.

In the example illustrated, tubing string module 44 comprises an orienting portion 49 having a plurality, e.g. a pair, of orienting profiles 50 facing toward each other. The orienting profiles 50 may be part of corresponding alignment mules 52, such as intervention alignment mules oriented such that the profiles 50 face one another. The alignment mules 52 may be positioned within a spacer sleeve 54 located in a module body 55. Additionally, the tubing string module 44 comprises a key profile 56 designed to receive and lock the locating keys 38. By way of example, the key profile 56 may be contained in a latch portion 57 formed by a latch sub assembly 58 or other suitable portion of module 44.

Figure 3:
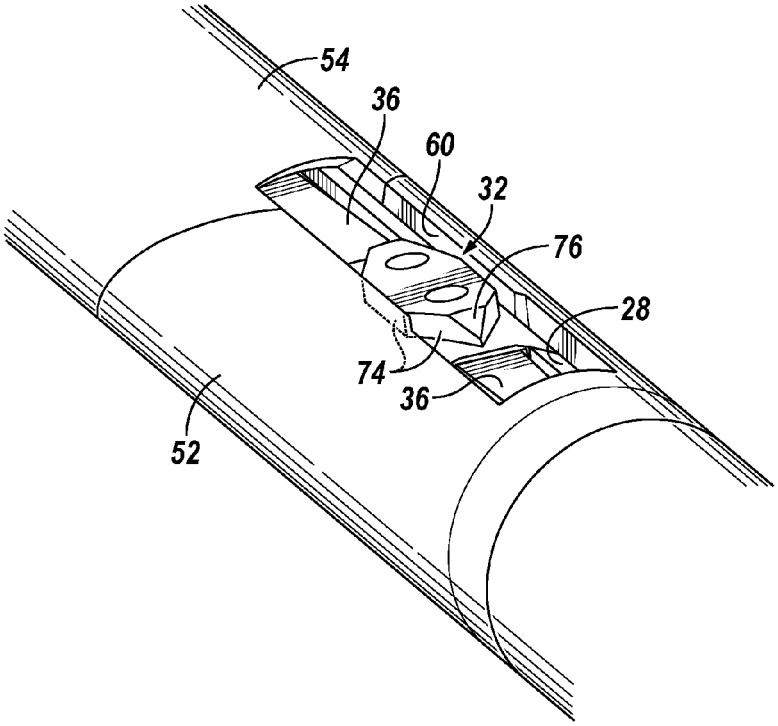
FIG. 3 is an orthogonal view of an example of an orienting key employed in orienting a tool via the orienting and locating mechanism, according to an embodiment of the disclosure.

When the orienting and locating mechanism 20 is moved longitudinally downhole and into interior 48 of tubing string module 44, the orienting key 32 is consequently moved into a space 59 between orienting profiles 50. In the example illustrated, the orienting key 32 is installed at the bottom or lead end of the orienting and locating mechanism 20. As the orienting key 32 reaches the space between profiles 50, e.g. helical profiles, spring members 36 move the orienting key 32 radially outward so that it engages orienting profiles 50. The orienting and locating mechanism 20, along with tool 22, is then stroked back and forth such that the interaction between orienting key 32 and profiles 50 causes rotation of the orienting and locating mechanism 20/tool 22 relative to tubing string module 44. The back and forth motion is continued until the orienting key 32 is moved into an alignment slot 60 for proper alignment of tool 22, as further illustrated in FIG. 3. Use of the cooperating profiles 50 and the back and forth motion enables rotational orientation of the tool 22 when using flexible conveyance 26, e.g. coiled tubing, slick line, or other conveyances which have limited capability for rotational orientation through application of torque along the conveyance.

As the orientation key 32 is moved into alignment slot 60, the locating keys 38 are moved into the key profile 56. If the key profile 56 matches the locating keys 38, the orienting and locating mechanism 20 becomes locked at that particular location. If, on the other hand, the locating keys 38 do not match the key profile 56, locking fails to occur and the orienting and locating mechanism 20 may be moved to another location, e.g. to another lateral junction, for mating of the locating keys 38 with the appropriate corresponding key profile 56. The locating keys 38 and the orienting key 32 may be mounted on spring members 40, 36, respectively, to enable radially inward contraction of the keys 32, 38 when sufficient longitudinal force is applied via conveyance 26. As discussed above, each locating key 38 may be mounted on a separate beam spring 40.

In the illustrated embodiment of mechanism 20, the locating keys 38 comprise spring members 40 in the form of a plurality of cantilever beams. Each cantilever beam spring 40 is mounted to body 28 at a fixed end and is designed to flex relative to the fixed end, thus allowing individual keys 38 to deflect radially when passing through the tubing string 24 prior to reaching the appropriate key profile 56. In some applications, the key profile 56 may be formed with a plurality, e.g. three, interchangeable profile members which may be used with module body 55 and selectively interchanged with other profile members without changing module body 55. Additionally, the locating keys 38 may be designed with longitudinal edges 62 and circumferential edges 64 which are captured by the key profile 56 to provide both axial and radial constraint when the locating keys 38 are engaged with the proper key profile 56. Once the locating keys 38 are locked, a substantially higher, predetermined axial load is applied to release the latching keys 38 from the key profile 56 for movement, e.g. retrieval, of orienting and locating mechanism 20 along tubing string 24. Application of the predetermined axial load or a near predetermined axial load can be used to confirm and verify positive engagement of the latching keys 38 with the proper corresponding key profile 56.

Figure 4:
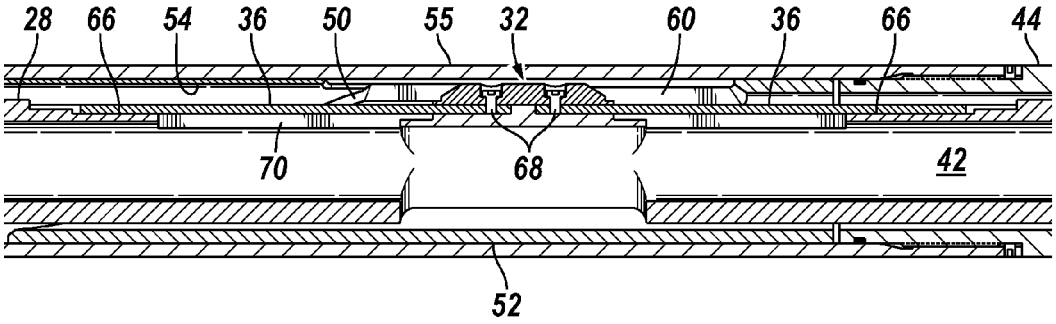
FIG. 4 is an axial cross-sectional view of a portion of the orienting and locating mechanism deployed in a tubing string module, according to an embodiment of the disclosure.
Figure 5:
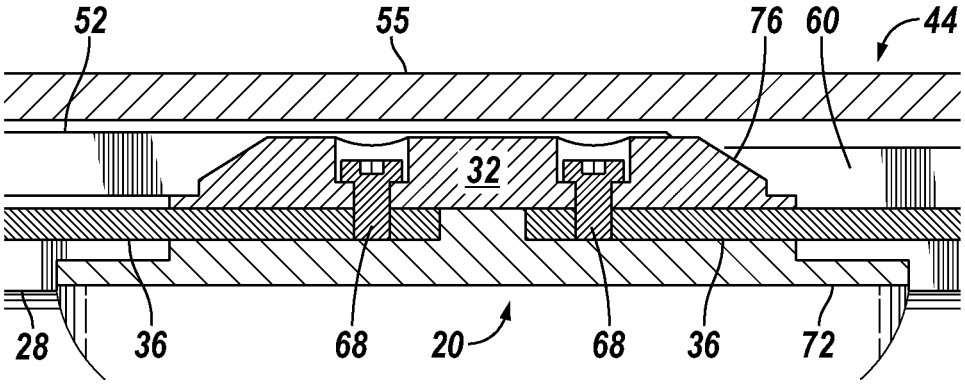
FIG. 5 is a cross-sectional view of the orienting key illustrated in FIG. 3, according to an embodiment of the disclosure.

Referring again to FIG. 3, an embodiment of orienting key 32 is illustrated as mounted onto beam springs 36 which may be used to assemble the orienting key 32 to the body 28. With additional reference to FIG. 4, the beam springs 36 may be supported by flat surfaces 66 which form part of the cylindrical body 28. The beam springs 36 are attached to the orienting key 32 by a suitable fastener 68, such as bolts or other appropriate fasteners. The beam springs 36 also hold the orienting key 32 in a slot 70 extending radially through body 28 and bias the orienting key 32 toward engagement with profiles 50 of alignment mules 52, as illustrated in FIGS. 4 and 5. Once installed, the beam springs 36 naturally bias the orienting key 32 in this radially outward direction. However, the orienting key 32 may comprise tabs 72 which extend outwardly a sufficient distance to engage an inner surface of the body 28, thus restricting further radially outward movement of the orienting key 32.

The orienting key 32 also may comprise side faces 74 (see FIG. 3) which guide the alignment key 32 along the orienting profiles 50 and also rotationally secure the orienting key 32 within alignment slot 60. The orienting key 32 may further comprise a lead surface 76 (see FIG. 5) which is angled or otherwise formed to control the linear force required to cause the orienting key 32 to move radially inward against the bias of springs 36 as the orienting and locating mechanism 20 is moved to another location along the tubing string 24. The locating keys 38 may have similarly angled lead surfaces, e.g. angled lead longitudinal edges 62, designed to establish a predetermined linear force to disengage the locating keys 38 from the key profile 56. This axially directed predetermined linear force may be used to verify engagement of locating keys 38 with the proper key profile 56 by applying a pull force to the conveyance 26.

Figure 6:
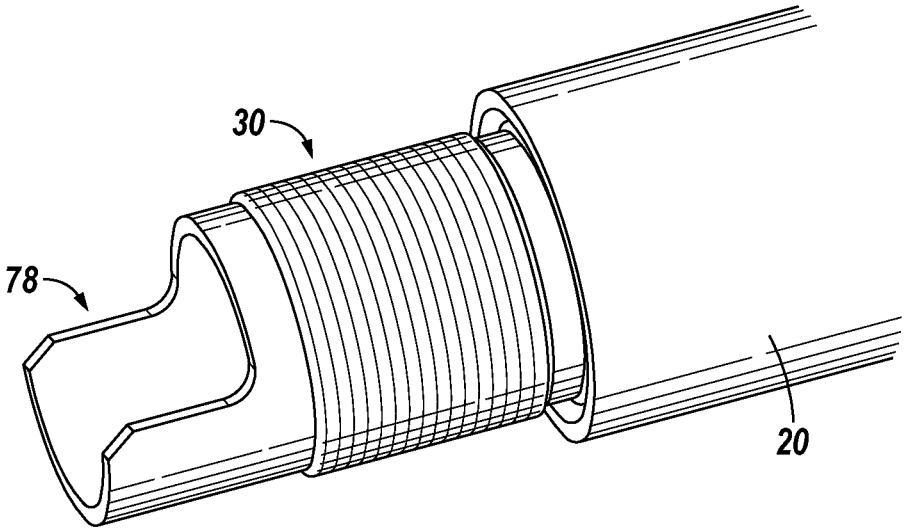
FIG. 6 is an orthogonal view of an example of a connector end for coupling the tool to the orienting and locating mechanism, according to an embodiment of the disclosure.
Figure 7:
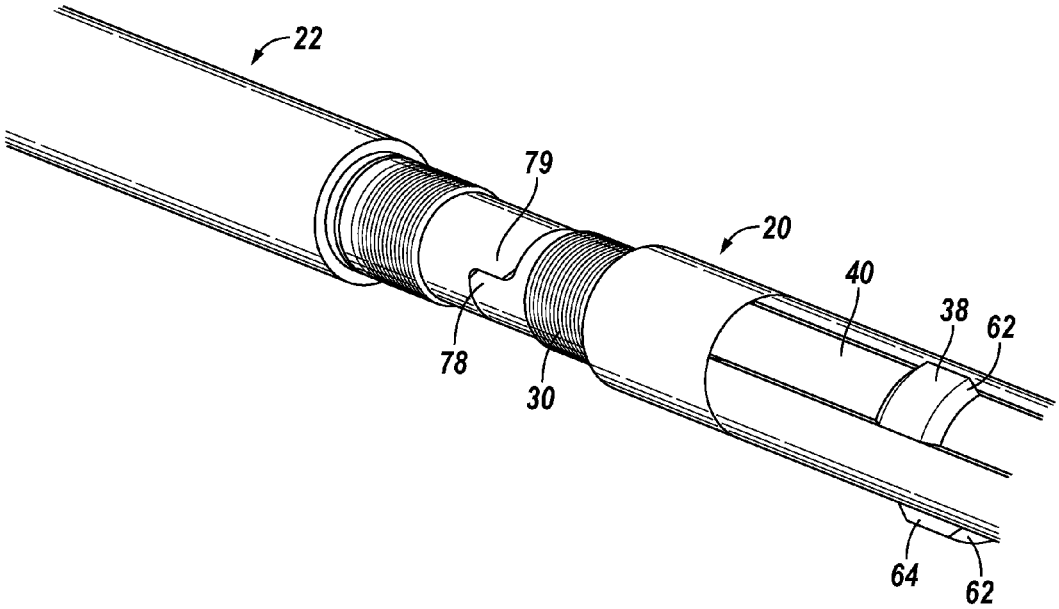
FIG. 7 is an orthogonal view of an example of a tool oriented via the connector end with respect to the orienting and locating mechanism, according to an embodiment of the disclosure.

Referring generally to FIG. 6, an example of connector end 30 is illustrated. In this example, the connector end 30 has a castellated profile 78 that enables pre-alignment of the tool 22, e.g. lateral deflector, with the orienting and locating mechanism 20. However, a variety of other profiles and features may be used in applications which align tool 22 in a specific orientation with respect to orienting and locating mechanism 20. In the example illustrated in FIG. 7, the tool 22 comprises a lateral deflector with a corresponding castellated profile 79. The lateral deflector/tool 22 is pre-aligned via castellated profiles 78, 79 during assembly of the tool 22 and orienting and locating mechanism 20 to enable proper alignment of tool/lateral deflector 22 with a corresponding window sub installed downhole along tubing string 24.

Figure 8:
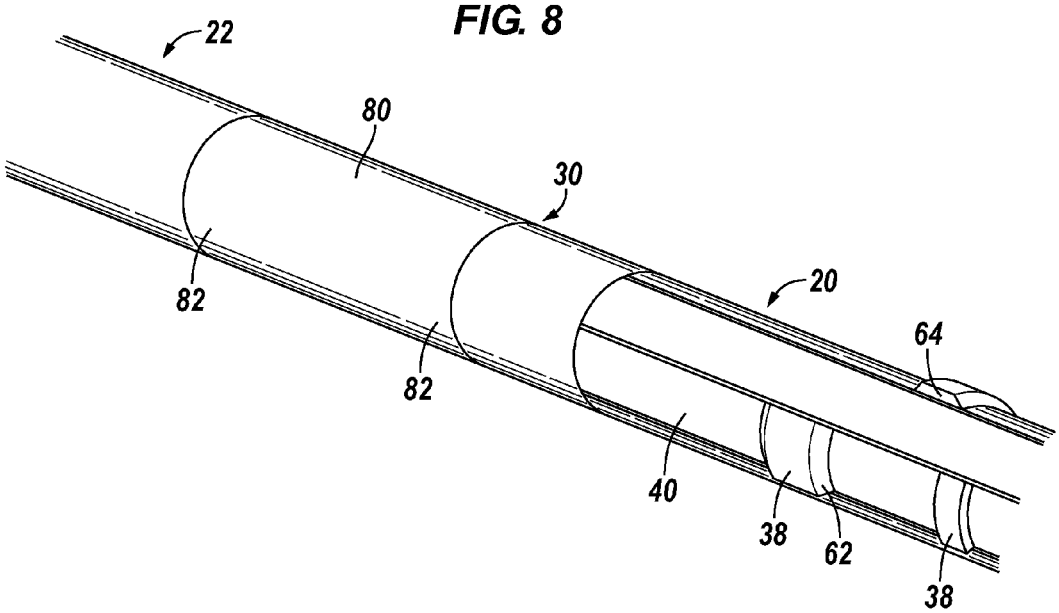
FIG. 8 is an orthogonal view of an example of a tool coupled to the orienting and locating mechanism, according to an embodiment of the disclosure.

After aligning and engaging the tool 22 with end 30 of the orienting and locating mechanism 20, the components may be joined by a suitable coupler 80, as illustrated in FIG. 8. Although coupler 80 may have a variety of forms, the illustrated example comprises a turnbuckle type coupler. The turnbuckle coupler 80 has a left-hand thread on one end and a right-hand thread on the other end oriented to engage corresponding threaded regions 82 on the tool 22 and on the end 30 of orienting and locating mechanism 20. The left-hand and right-hand threads enable simultaneous makeup of both the tool 22 and the orienting and locating mechanism 20 by turning the coupler 80 in one direction, e.g. to the right. When the threaded regions 82 are fully engaged, the castellated profiles 78, 79 remain aligned as well.

Depending on the type of tool 22 and the specific downhole operation, various other features and components may be substituted or added to orienting and locating mechanism 20. For example, a guiding bullnose may be attached, e.g. threadably engaged, to a lead end of the orienting and locating mechanism 20. The guiding bullnose serves to ease out the intervention of the mechanism 20 as it is run downhole through tubing string 24. Another example of an additional component is a slip retainer sleeve that may be attached, e.g. threadably attached, to the body 28. Slip retainer sleeves may be used to cover and/or protect other components. For example, a slip retainer sleeve may be located to hold set screws in place, thus preventing the set screws from backing out due to vibration as the tool 22 is run downhole through tubing string 24. Examples of such set screws include set screws which may be used to secure the locating keys 38 to spring members 40.

In an operational example, the orienting and locating mechanism 20 is run downhole through tubing string 24 with tool 22, e.g. a lateral deflector or isolator. The orienting key 32 and the locating keys 38 are spring mounted and deflect radially inwardly to pass through smaller bore diameters. Mechanism 20 and tool 22 are run downhole on flexible conveyance 26 in the form of, for example, slick line or coil tubing. Thus, the conveyance is not able to rotate the assembly to accomplish proper alignment. However, once the orienting key 32 reaches the space 59 between orienting profiles 50, the orienting and locating mechanism 20 may be moved back and forth, e.g. jarred up-and-down, until the orienting key 32 reaches alignment with alignment slot 60.

Alignment slot 60 is oriented to place locating keys 38 into proper alignment with key profile 56 of the latch subassembly 58, thus properly orienting tool 22. Movement of orienting key 32 along alignment slot 60 moves locating keys 38 into locking engagement with key profile 56 if the key profile 56 has the desired, matching profile. The locating keys 38 and key profile 56 are designed to provide a positive locking and orientation confirmation once engaged. As described above, the locating keys 38 and key profile 56 may be designed to provide axial and radial constraint once the locating keys 38 are engaged and locked within key profile 56. A predetermined pull force may be applied to conveyance 26 to confirm that the keys 38 are locked in the proper key profile 56. To retrieve tool 22 and orienting and locating mechanism 20 out of hole, a straight pull force is applied on conveyance 26 at a level greater than a predetermined release force to snap out the locating keys 38 from the key profile 56 and latch subassembly 58.

Although many types of tools 22 may be deployed in many types of downhole operations and other operations, the orienting and locating mechanism is useful in multilateral well applications. During construction of a multi-lateral junction, such as a TAML Level 5 multilateral junction, in multilateral well 46, tubing string module 44 may be installed in the form of a selective lateral intervention completion module. In this example, module 44 is designed to allow the option of single tubing production from a reservoir or commingled fluid flow with the ability to deflect out the lateral bore through production tubing. In this type of application, a Y-block may be installed to allow dual completion and to permit independent fluid production from two different reservoirs with pressure isolation. The Y-block also can accommodate reentry into the lateral bore of the multilateral junction for further intervention work.

In this example, the single and/or dual tubing production is accomplished by isolating a main bore from a lateral bore at the multilateral junction. This may be accomplished by utilizing a seal stem with V-seal stacks or other suitable seals located at the top and bottom of a window sub in the module 44. The orienting and locating mechanism 20 may be used to orient and locate tool/lateral deflector 22 at the multilateral junction to guide tools from the main bore into the lateral bore. Depending on the desired intervention and/or production operations, the orienting and locating mechanism 20 may be used to deliver, orient and locate lateral deflectors, isolators, or other suitable tools into the previously installed tubing string module 44.

Depending on the application, the tool 22 and mechanism 20 may be constructed in several configurations. For example, many types of tools may be coupled to the orienting and locating mechanism via various types of connector ends. Additionally, the orienting key and locating key may be constructed in various sizes and configurations and such keys may be spring biased via a variety of springs. In multilateral well applications, the key profile may be different for each lateral bore junction and thus the locating keys can be arranged to match a specific, selected multilateral junction. The orienting profiles may be helical or they may follow other suitable paths. Additionally, the orienting profiles may be created by alignment mules or other components or features of the orienting and locating mechanism. The materials used to form the tool and the orienting and locating mechanism components also may vary widely depending on the specifics of a given application.

Although a few embodiments of the disclosure have been described in detail above, those of ordinary skill in the art will readily appreciate that many modifications are possible without materially departing from the teachings of this disclosure. Accordingly, such modifications are intended to be included within the scope of this disclosure as defined in the claims.

What is claimed is:

1. A method for positioning in a tubing, comprising:

coupling a tool to an orienting and locating mechanism having a locating key and an orienting key;

using a conveyance to deliver the tool and the orientating and locating mechanism through a tubing string until the orienting key is positioned between a pair of alignment mules located in the tubing string;

moving the orienting key back and forth along the pair of alignment mules by stroking the orienting and locating mechanism back and forth until a desired rotational orientation is achieved;

after the desired rotational orientation is achieved, moving the locating key into a key profile positioned in the tubing string; and verifying that the locating key is in the appropriate key profile.

2. The method as recited in claim 1, wherein coupling comprises coupling a lateral deflector to the orienting and locating mechanism.

3. The method as recited in claim 1, wherein coupling comprises coupling an isolator to the orienting and locating mechanism.

4. The method as recited in claim 1, wherein using comprises using coil tubing to deliver the tool and the orienting and locating mechanism through the tubing string, the tubing string being located in a multilateral well.

5. The method as recited in claim 1, wherein using comprises using slick line to deliver the tool and the orienting and locating mechanism through the tubing string, the tubing string being located in a multilateral well.

6. The method as recited in claim 1, further comprising mounting the orienting key on a spring member which allows the orienting key to be forced radially inwardly during movement to a location between the pair of alignment mules.

7. The method as recited in claim 1, further comprising forming the locating key as a plurality of locating keys which interact with the key profile to hold the orienting and locating mechanism against linear and rotational movement with respect to the tubing string.

8. The method as recited in claim 7, further comprising spring mounting the plurality of locating keys.

9. The method as recited in claim 1, further comprising moving the orienting and locating mechanism through a first key profile to reach the key profile matching the locating key.

10. The method as recited in claim 1, wherein verifying comprises applying a predetermined tensile load to the conveyance to verify that the locating key has locked into the appropriate key profile.

11. A system for use in a wellbore, comprising:

a tubing string having a string module with an orienting portion and a latch portion, the orienting portion including a plurality of alignment mules;

an orienting and locating mechanism comprising an orienting key and a locating key; and a tool mounted to the orienting and locating mechanism, the orienting key cooperating with the orienting portion to rotate the tool to a desired orientation as the orienting and locating mechanism is stroked back and forth in the orienting portion, the locating key locking into the latch portion once the tool is oriented and moved longitudinally to the latch portion.

12. The system as recited in claim 11, wherein the string module comprises a multilateral junction module.

13. The system as recited in claim 11, wherein the orienting key is spring mounted.

14. The system as recited in claim 11, wherein the orienting key is spring mounted on a plurality of beam springs.

15. The system as recited in claim 11, wherein the locating key comprises a plurality of locating keys and the latch portion comprises a key profile matching the plurality of keys when the locating key is positioned at the desired latch portion.

16. The system as recited in claim 15, wherein the key profile holds the plurality of locating keys against longitudinal and rotational movement.

17. The system as recited in claim 15, wherein the locating keys of the plurality of locating keys are spring mounted.

18. A method, comprising:

coupling a tool to an orienting and locating mechanism;

deploying the tool and the orienting and locating mechanism downhole to a lateral junction via coil tubing;

orienting the tool rotationally by reciprocating the orienting and locating mechanism between orienting profiles; and latching the orienting and locating mechanism at a desired longitudinal location via a key and a corresponding key profile;

wherein orienting comprises moving a spring mounted orienting key back and forth against the orienting profiles of a pair of orienting mules.

19. The method as recited in claim 18, wherein coupling comprises coupling a lateral deflector to the orienting and locating mechanism.

* * * * *